US007171730B2

(12) United States Patent
Kasai

(10) Patent No.: US 7,171,730 B2
(45) Date of Patent: Feb. 6, 2007

(54) PLASTIC CHUCK WITH HIGHLY AIRTIGHT SLIDER AND BAG BODY WITH THE CHUCK

(75) Inventor: Juichi Kasai, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 107 days.

(21) Appl. No.: 10/415,887

(22) PCT Filed: Nov. 12, 2001

(86) PCT No.: PCT/JP01/09867

§ 371 (c)(1),
(2), (4) Date: May 9, 2003

(87) PCT Pub. No.: WO02/38459

PCT Pub. Date: May 16, 2002

(65) Prior Publication Data

US 2004/0025308 A1 Feb. 12, 2004

(30) Foreign Application Priority Data

Nov. 13, 2000 (JP) ..... 2000-345057

(51) Int. Cl.
*B65D 33/00* (2006.01)

(52) U.S. Cl. ..... 24/30.5 R; 24/389; 24/400

(58) Field of Classification Search ..... 24/30.5 R, 24/399, 30.5 P, 400, 384, 389; 383/384, 383/389, 210–211, 61.2, 61.3, 63, 64, 69
See application file for complete search history.

(56) References Cited

U.S. PATENT DOCUMENTS 3,176,364 A * 4/1965 Dritz ..... 24/304
3,339,606 A * 9/1967 Kugler ..... 383/63
3,440,696 A * 4/1969 Staller ..... 24/586.1
4,791,710 A * 12/1988 Nocek et al. ..... 24/585.12
4,947,525 A * 8/1990 Van Erden ..... 24/304
5,140,796 A * 8/1992 Pope ..... 53/390
5,224,779 A * 7/1993 Thompson et al. ..... 383/5
5,356,222 A * 10/1994 Kettner et al. ..... 383/63
5,474,382 A * 12/1995 May ..... 383/211
6,290,393 B1 * 9/2001 Tomic ..... 383/210.1
6,293,701 B1 * 9/2001 Tomic ..... 383/64

FOREIGN PATENT DOCUMENTS

| | | |
|---|---|---|
| JP | 191336/1984 | 12/1984 |
| JP | 38746/1991 | 4/1991 |
| JP | 5-505325 | 8/1993 |
| JP | 3000905 | 8/1994 |
| JP | 8-324595 | 12/1996 |

* cited by examiner

*Primary Examiner*—James R. Brittain
(74) *Attorney, Agent, or Firm*—Oblon, Spivak, McClelland, Maier & Neustadt, P.C.

(57) ABSTRACT

A plastic zipper equipped with a slider, which zipper is imparted with high hermetical-sealability and facility in unsealing and reopening/reclosing. The zipper is capable of detection of its having been unsealed after sealing packaging, and a bag body is fitted with the zipper with a slider attached. The zipper portion is bonded in the plastic zipper equipped with a slider or protrusion portions for slider guide via an easily peelable plastic layer and two different colors are imparted to the resin at the portion to be bonded. The bag body is capable of assuring high hermetical-sealability enabling long-term preservation of contents therein, is easy to open, and is imparted with a function of revealing unjust unsealing as well.

4 Claims, 16 Drawing Sheets

PLASTIC CHUCK WITH HIGHLY AIRTIGHT SLIDER AND BAG BODY WITH THE CHUCK

TECHNICAL FIELD

The present invention relates to a highly hermetically-sealable plastic zipper equipped with a slider which zipper is employed in packaging materials for foods, pharmaceuticals, electronic part items and the like, and enables easy opening and resealing, while maintaining hermetical sealability; and to a bag body fitted with the above-mentioned zipper. It also pertains to a plastic zipper equipped with a slider which zipper enables detection of its having been unsealed after sealing packaging; and to a bag body fitted with the zipper just mentioned.

BACKGROUND ART

There are widely employed, as packaging materials for a variety of articles in the fields of foods, pharmaceuticals, electronic part items and the like, bag bodies each fitted with a plastic zipper. In particular, there are widely employed plastic zippers each equipped with a slider because of easiness in opening and closing and its capability of resealing. Thus, accompanying the diversification of objects to be packaged, it follows that higher hermetical-sealability is required of the plastic zippers. At the same time, it is desired that the zipper be endowed with the function capable of detection of its having been unsealed after sealing packaging, since unsealing thereafter due to an unfair purpose or mistake brings about such disadvantages as foreign matters being mixed in and impaired quality of the content in the bag bodies.

FIG. 9 through FIG. 15 each illustrate an example of a previously known plastic zipper which is equipped with a slider, and is endowed with high hermetical-sealability and/or function capable of detecting unsealing.

The example as illustrated on FIG. 9 (perspective view) and FIG. 10 (cross sectional end view taken along line A–A' of FIG. 9) point out a system wherein the top portion of a bag body fitted with a zipper in which a bag 9-3 is fitted with a zipper 9-2 and a slider 9-1 is covered with a cover film 9-4 bearing perforated line 9-5 so that the portions of the slider and zipper are overspread therewith, and in the case of unsealing for the first time, the perforated line 9-5 are cut off and thereafter the zipper is opened/closed by means of the slider. The above-mentioned system has simple structure and favorable operability, but suffers from such disadvantages as unfavorable appearance and inferior productivity from the industrial viewpoint.

The example as illustrated on FIG. 11 (perspective view) and FIG. 12 (cross sectional end view taken along line B–B' of FIG. 11) point out a system wherein a partition film 11-4 bearing perforated line 11-5 is installed inside a bag body fitted with a zipper in which a bag 9-3 is fitted with a zipper 9-2 and a slider 9-1, and in the case of unsealing for the first time, the zipper is opened by means of the slider and thereafter, the perforated line 11-5 are opened. The above-mentioned system has favorable appearance and good productivity, but involves such a problem that in the case of the content being fine particles such as powder, the partition film portion is plugged up with the fine particles, thereby making it impossible to smoothly discharge the same.

The example as illustrated on FIG. 13 (perspective view) indicates a system wherein a bag body fitted with a zipper in which a bag 9-3 is fitted with a zipper 9-2 and a slider 9-1 is subjected to spot welding (13-1) at the top portion of the zipper in a state that the slider is at the closing position, and in the case of unsealing for the first time, the weld portion is cut away with the slider.

The method as illustrated on FIG. 14 (perspective view) indicates a system wherein part of a zipper top portion 14-4 bearing perforated line 14-5, etc. is cut off in a state that the zipper 9-2 is set at the closing position of the bag 9-3, a slider is attached to the cut portion, and in the case of unsealing, the zipper top portion 14-4 is cut away along the perforated line.

The systems as illustrated on FIG. 9 and FIG. 11 is advantageous in that the hermetical sealability of the bag body can be assured by the adoption of the hermetical-sealed perforated line, whereas the systems as illustrated on FIG. 13 and FIG. 14, the hermetical sealability of the bag body depends upon the hermetical sealability of the zipper itself, thus making the above-cited systems unusable in applications based on the precondition of long-term preservation such as retort pouch.

DISCLOSURE OF THE INVENTION

As a result of intensive research and investigation, the present inventor has developed a plastic zipper equipped with a slider which zipper has hermetical sealability to a high degree, and further facilitates unsealing and reopening/reclosing; a plastic zipper equipped with a slider which zipper has, in addition to the aforesaid capability, a function capable of detection of its having been unsealed after sealing packaging; and a bag body fitted with either of the above-mentioned zippers equipped with a slider.

The means for solving the subjects are summarized as follows.

1. In a plastic zipper equipped with a slider, comprising a pair of male hook and female hook formed on surfaces of plastic films, a continuous tightening wall which is parallel to the male hook and placed inside the male hook and a continuous pressing rib which is parallel to the female hook and placed inside the female hook; the continuous tightening wall and the continuous pressing rib are bonded to each other in a state of the zipper being engaged via an easily peelable plastic layer which is installed in advance on the surface of at least one of the continuous tightening wall and the continuous pressing rib (hereinafter referred to as the "first aspect of the present invention").
2. In a plastic zipper equipped with a slider, comprising a pair of male hook and female hook formed on surfaces of plastic films; a top portion of the male hook and a bottom portion of the female hook are bonded to each other in a state of the zipper being engaged via an easily peelable plastic layer which is installed in advance on the surface of at least one of a top portion of the male hook and a bottom portion of the female hook (hereinafter referred to as the "second aspect of the present invention").
3. In a plastic zipper equipped with a slider, comprising a pair of male hook and female hook formed on surfaces of plastic films, and a pair of protrusions for slider guide which are installed parallel to each of the male hook and female hook on the side of the opening portion; the pair of protrusions for slider guide are bonded to each other in a state of the zipper being engaged via an easily peelable plastic layer which is installed in advance on the inside surface of at least one of the protrusions (hereinafter referred to as the "third aspect of the present invention").

4. In a plastic zipper equipped with a slider, comprising a pair of male hook and female hook formed on surfaces of plastic films, a pair of protrusions for slider guide which are installed parallel to each of the male hook and female hook on the side of the opening portion, a continuous tightening wall which is parallel to the male hook and placed inside the male hook and a continuous pressing rib which is parallel to the female hook and placed inside the female hook; the pair of protrusions for slider guide are bonded to each other in a state of the zipper being engaged via an easily peelable plastic layer which is installed in advance on the inside surface of at least one of the protrusions and at the same time, the continuous tightening wall and the continuous pressing rib are bonded to each other in the state of the zipper being engaged via an easily peelable plastic layer which is installed in advance on the surface of at least one of the continuous tightening wall and the continuous pressing rib (hereinafter referred to as the "fourth aspect of the present invention").
5. In a plastic zipper equipped with a slider, comprising a pair of male hook and female hook formed on surfaces of plastic films, a pair of protrusions for slider guide which are installed parallel to each of the male hook and female hook on the side of the opening portion; the pair of protrusions for slider guide are bonded to each other in a state of the zipper being engaged via an easily peelable plastic layer which is installed in advance on the inside surface of at least one of the protrusions and at the same time, a top portion of the male hook and a bottom portion of the female hook are bonded to each other in a state of the zipper being engaged via an easily peelable plastic layer which is installed in advance on the surface of at least one of a top portion of the male hook and a bottom portion of the female hook (hereinafter referred to as the "fifth aspect of the present invention").
6. In the plastic zipper equipped with a slider as set forth in any of the preceding items 1 through 5, the color of the surface of the portions that are bonded to each other comprises two different colors.
7. A bag body fitted with the plastic zipper with a slider attached as set forth in any of the preceding items 1 through 6.

Figure 1:
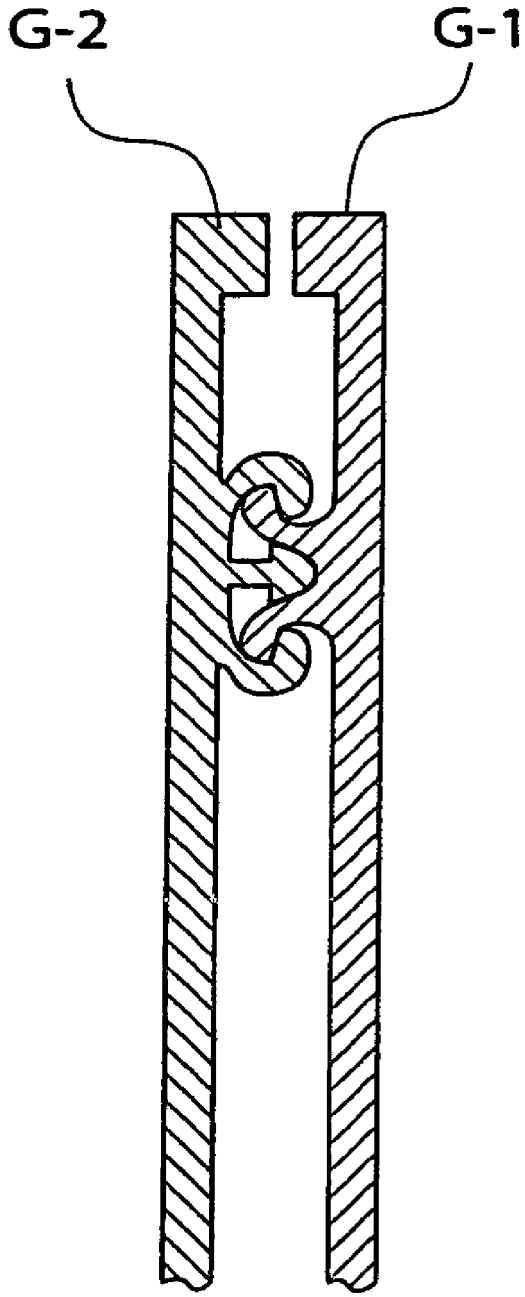
Fig1 PRIOR ART
FIG. 1 is a cross sectional view showing the engagement state of a hermetically-sealable plastic zipper.

The symbols in the drawings shall have the following designations:

1-1: male hook
1-2: continuous tightening wall
1-3: female hook
1-4: continuous pressing rib
G-1: protrusion for slider guide
G-2: protrusion for slider guide
A-1: easily peelable plastic layer
B-1: easily peelable plastic layer
5-1: female hook
5-2: male hook
A-5: easily peelable plastic layer
B-5: easily peelable plastic layer
A-8: easily peelable plastic layer
B-8: easily peelable plastic layer
9-1: slider
9-2: zipper
9-3: bag
9-4: cover film
9-5: perforated line
11-4: partition film
11-5: perforated line
13-1: spot welding
14-4: top portion of zipper
14-5: perforated line
15-1: inside guide of slider

THE MOST PREFERRED EMBODIMENT TO CARRY OUT THE INVENTION

The embodiments of the present invention will be described in more detail with reference to the attached drawings.

Figure 2:
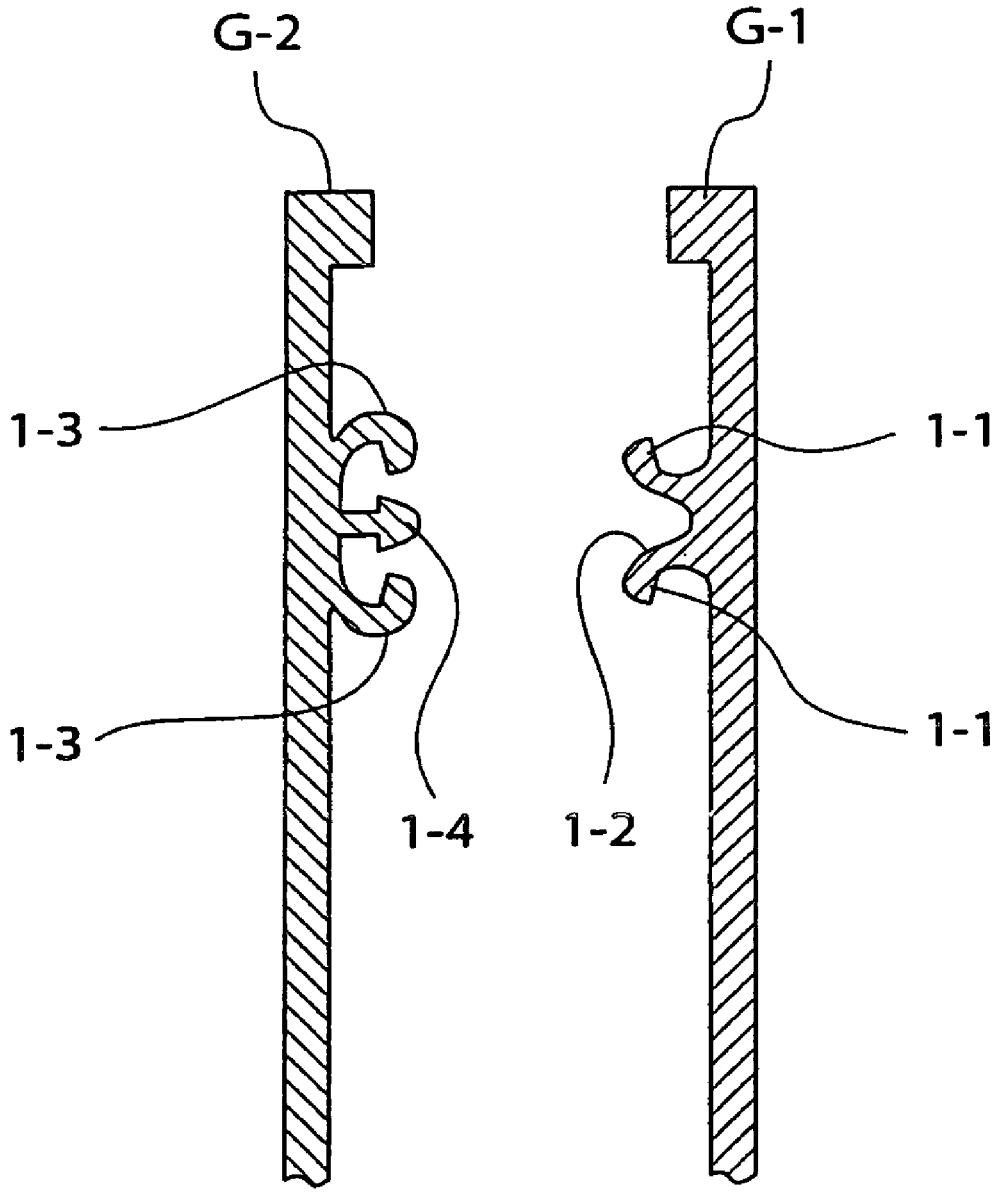
Fig2 PRIOR ART
FIG. 2 is a cross sectional view showing the disengagement state of a hermetically-sealable plastic zipper.

FIG. 1 and FIG. 2 are a cross sectional view showing the engagement state and disengagement state, respectively of the zipper as described in Japanese Patent Registration No. 2,938,784 (hereinafter referred to as "hermetically-sealable zipper"). The hermetically-sealable zipper is a plastic zipper comprising a pair of male hook and female hook formed on surfaces of plastic films, a continuous tightening wall 1-2 which is parallel to the male hook 1-1 and placed inside said hook and a continuous pressing rib 1-4 which is parallel to the female hook 1-3 and placed inside said hook, so that the zipper is imparted with persistent hermetical-sealability and also impact resistance to a high degree by the tight contact between the continuous tightening wall and the continuous pressing rib as well as self-tightening effect thereof. The hermetically-sealable plastic zipper is almost free from performance variation due to temperature variation, and accordingly is well suited for packaging liquid and the like. Therein, symbols G-1 and G-2 are each a protrusion for slider guide.

Figure 15:
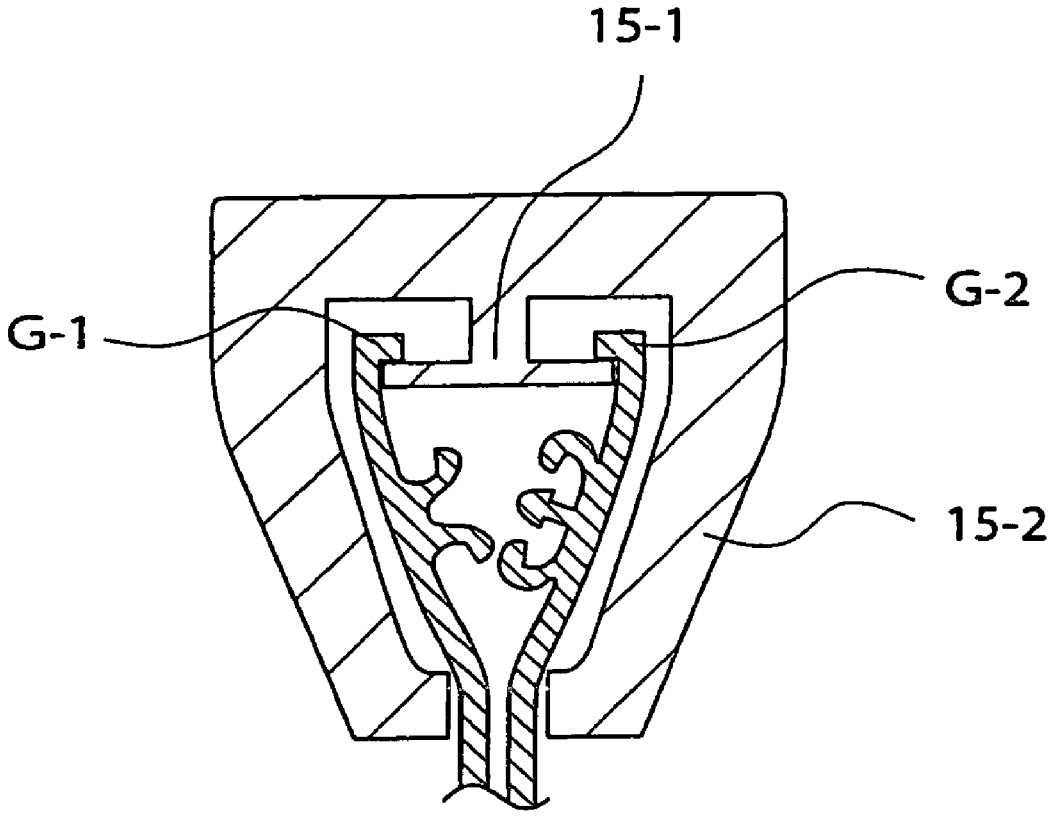
Fig15 PRIOR ART
FIG. 15 is a cross sectional view showing one example of slider for a hermetically-sealable plastic zipper.

As an example of sliders not impairing the hermetical sealability of a hermetically-sealable zipper, there is available a slider as described in Japanese Patent Application No. 316469/1999 (Heisei 11). As illustrated in FIG. 15, the hermetically-sealable plastic zipper can be opened and closed by that an inside guide 15-1 of the slider slides on the portion encompassed with the protrusions G-1 and G-2 for slider guide and the hooks on the opening side of the zipper, and that an outside guide 15-2 of the slider slides on the outside of the zipper.

In the first aspect of the present invention, the continuous tightening wall and the continuous pressing rib are bonded to each other in a state of the zipper being engaged via an easily peelable plastic layer which is installed in advance on the surface of at least one of the continuous tightening wall and the continuous pressing rib.

Figure 3:
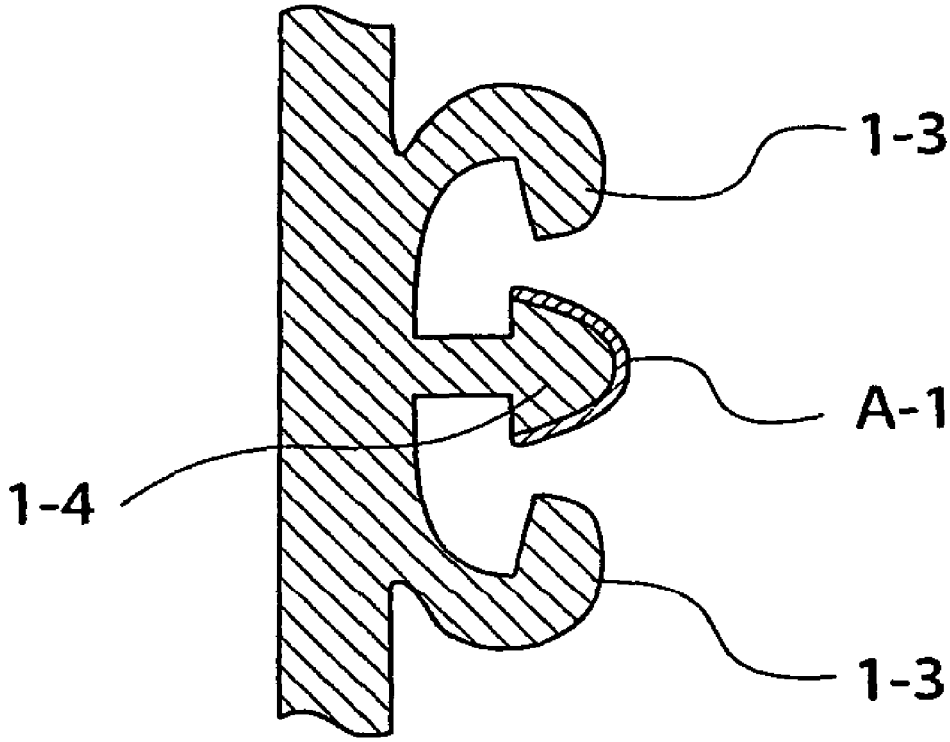
FIG. 3 is an enlarged cross sectional view showing a continuous pressing rib fitted with an easily peelable plastic layer.
Figure 4:
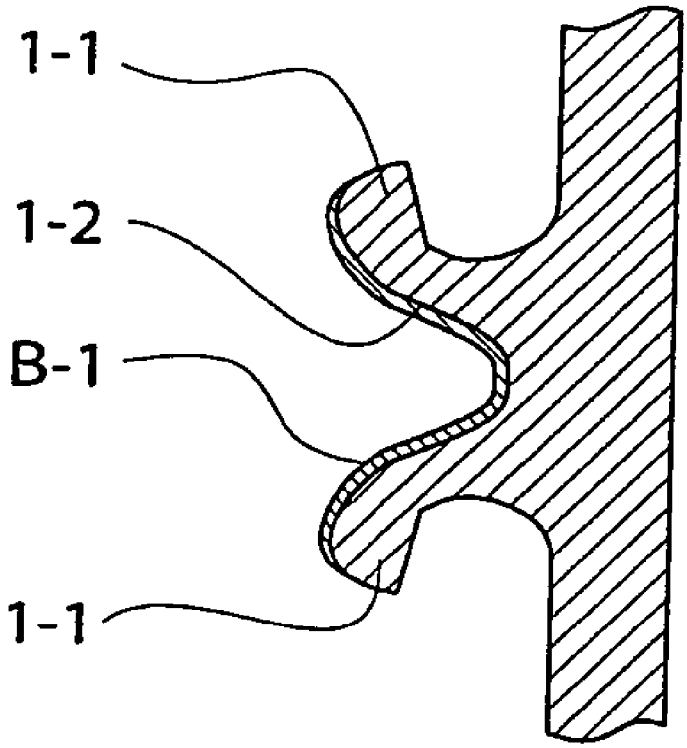
FIG. 4 is an enlarged cross sectional view showing a continuous tightening wall fitted with an easily peelable plastic layer.
Figure 16:
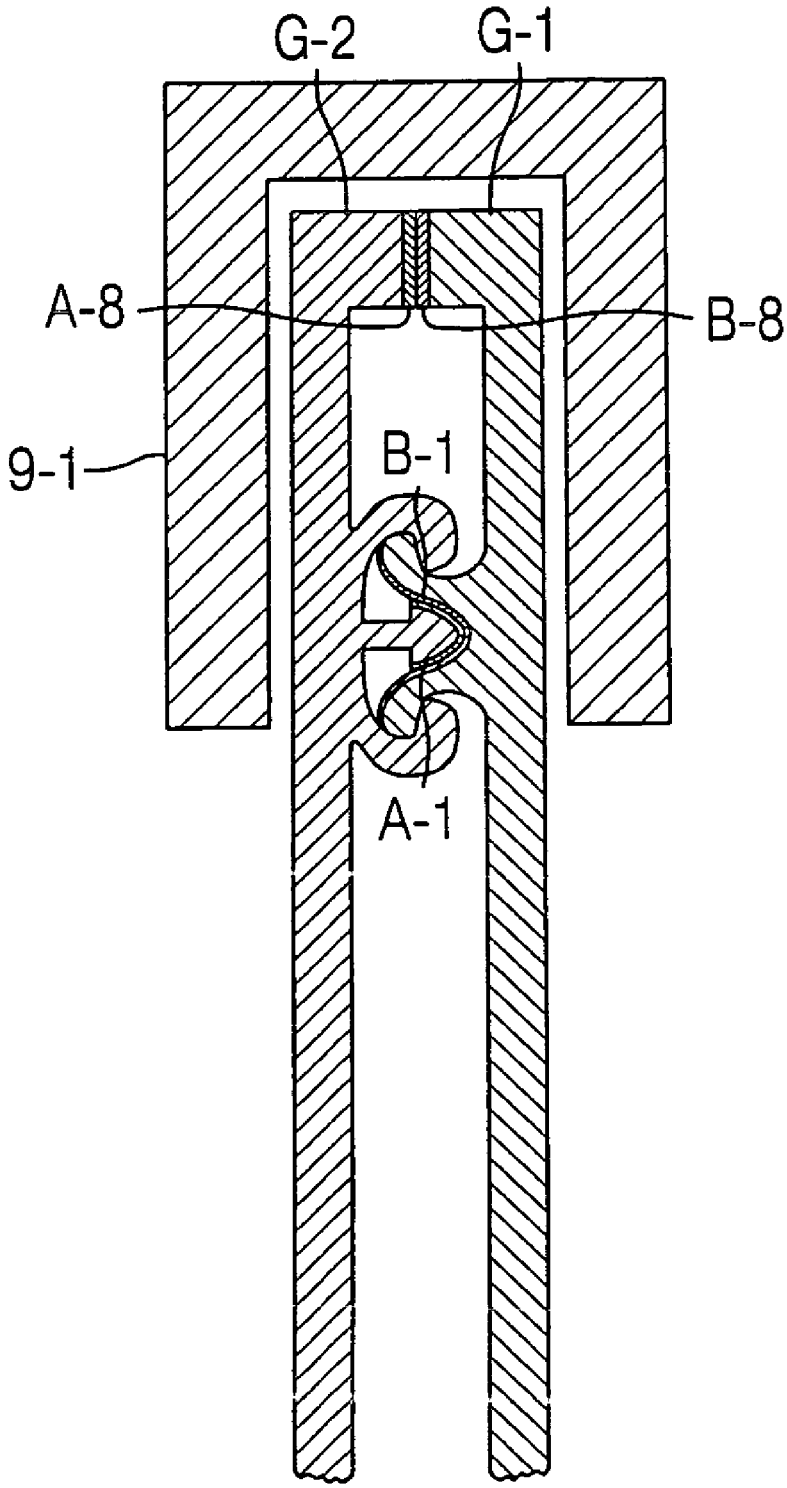
FIG. 16 is a cross sectional view showing the engagement state of a hermetically-sealable plastic zipper according to the present invention.

FIG. 3 and FIG. 4 are an enlarged cross sectional view showing a continuous pressing rib and a continuous tightening wall, respectively, and FIG. 16 is a cross section view showing the continuous pressing rib and the continuous tightening wall in an engagement state. In FIG. 3 the easily peelable plastic layer A-1 is installed on a surface of the continuous pressing rib 1-4, while in FIG. 4 the easily peelable plastic layer B-1 is installed on a surface of the continuous tightening wall 1-2. However, the easily peelable plastic layer need not be installed on both the continuous pressing rib and the continuous tightening wall, but may be installed on either of them only. As illustrated on FIG. 16, the continuous pressing rib and the continuous tightening wall are bonded to each other in a state of the zipper being engaged via an easily peelable plastic layer.

Figure 6:
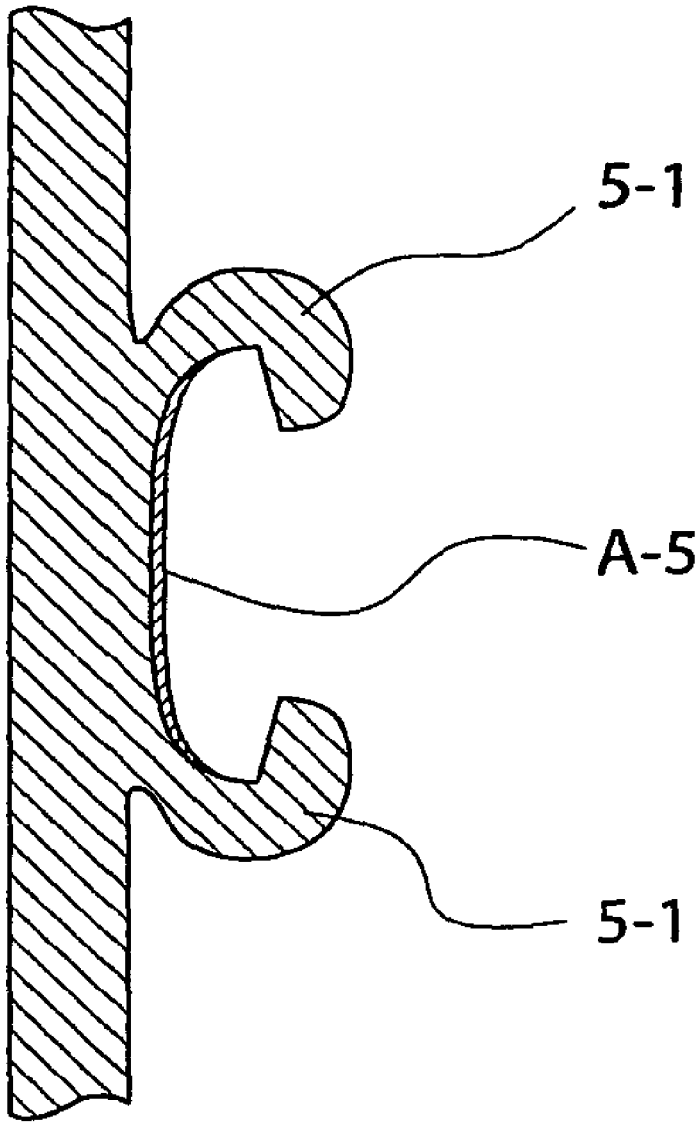
FIG. 6 is an enlarged cross sectional view showing a female hook fitted on the bottom surface with an easily peelable plastic layer.
Figure 7:
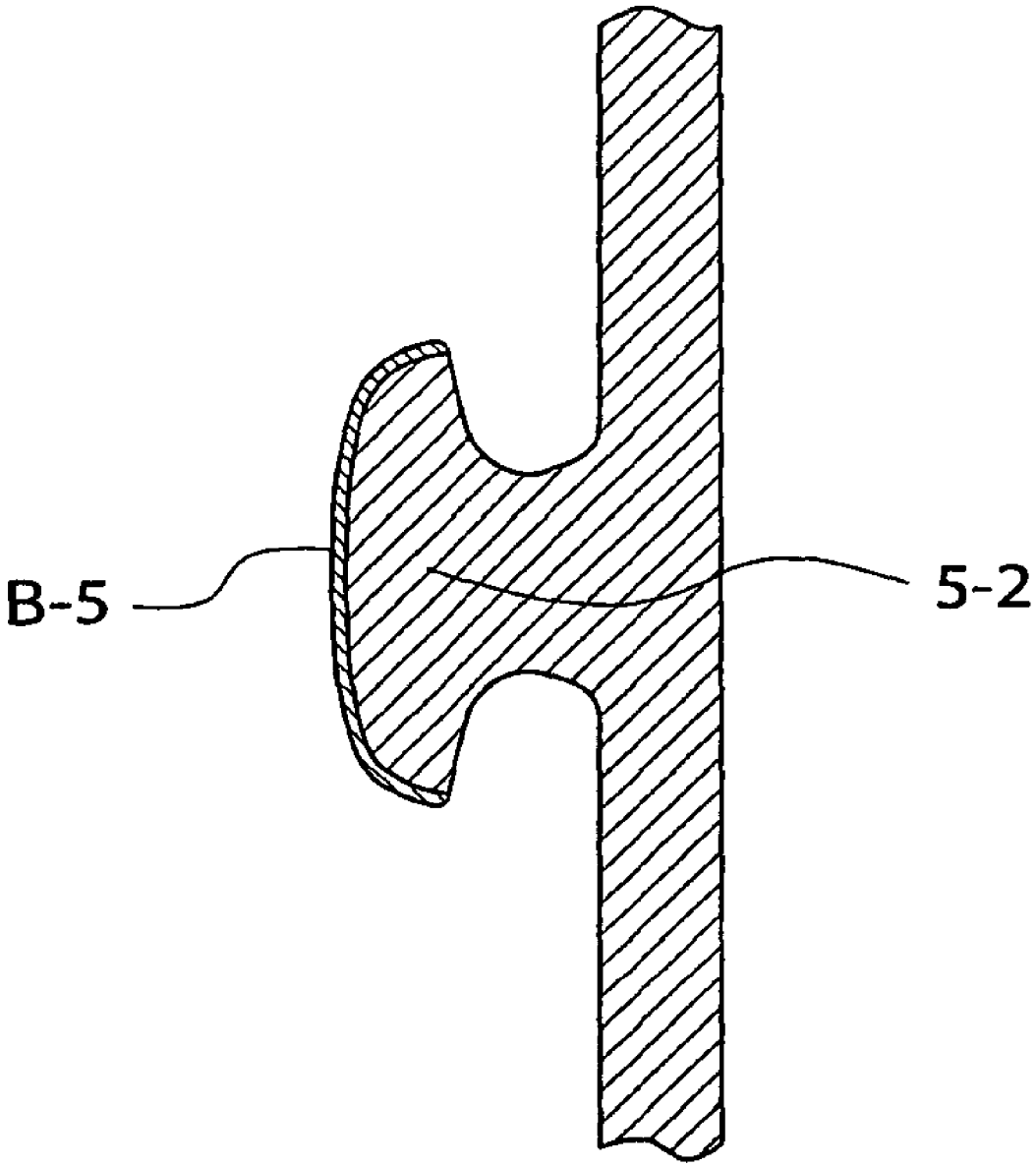
FIG. 7 is an enlarged cross sectional view showing a male hook fitted on the top surface with an easily peelable plastic layer.

In the following, some description will be given of the second aspect of the present invention with reference to FIG. 5, FIG. 6 and FIG. 7.

Figure 5:
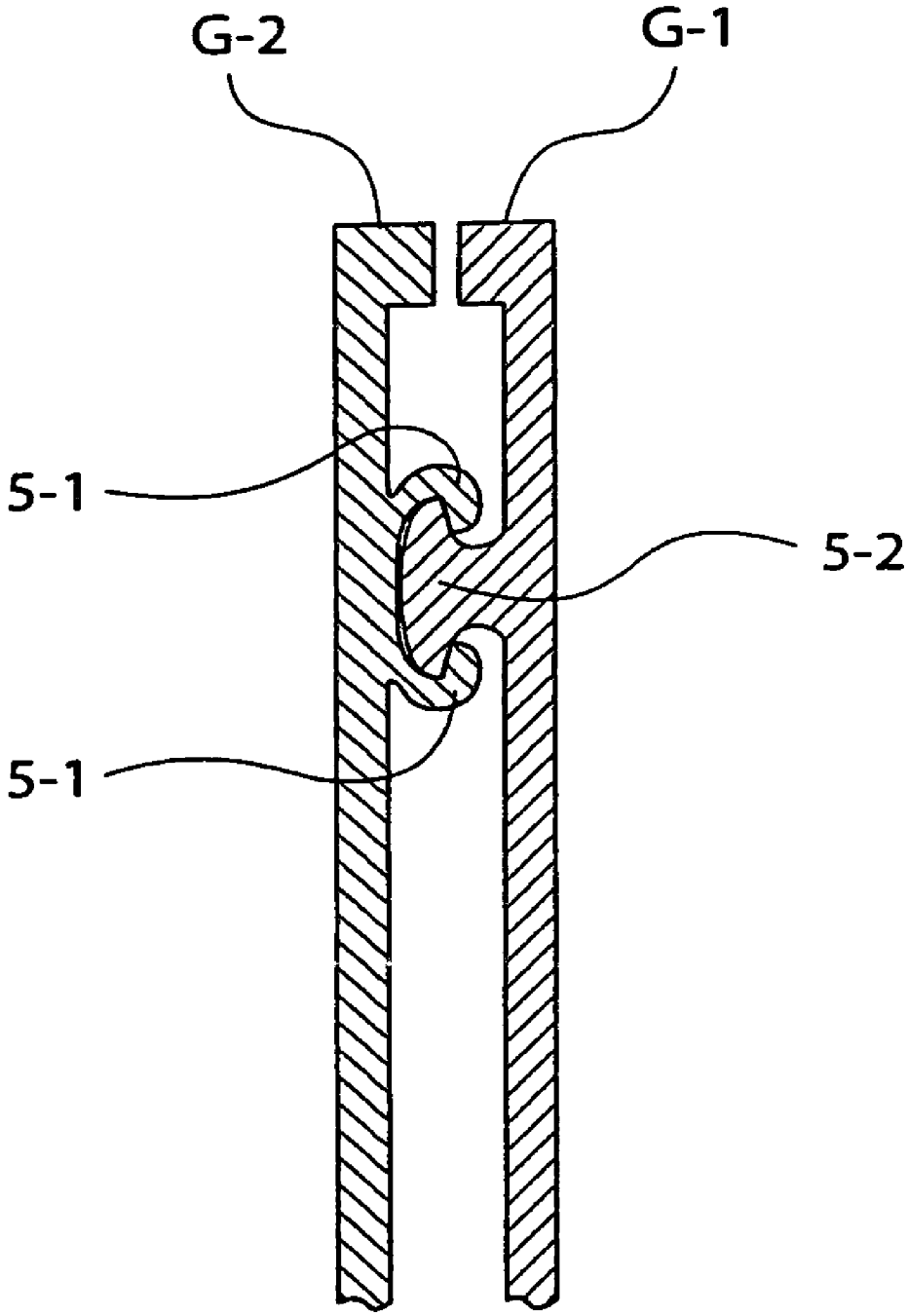
Fig5 PRIOR ART
FIG. 5 is a cross sectional view showing the engagement state of a conventional plastic zipper.

FIG. 5 is a cross sectional view showing the engagement state of a conventional plastic zipper comprising a male hook 5-2 and a female hook 5-1. In the second aspect of the present invention, as illustrated on FIG. 6 which is an enlarged cross sectional view showing a female hook, an easily peelable plastic layer A-5 is installed on the bottom surface of the female hook 5-1, while as illustrated on FIG. 7 which is an enlarged cross sectional view showing a male hook, an easily peelable plastic layer B-5 is installed on the top surface of the male hook 5-2. However, the easily peelable plastic layer need not be installed on both the bottom surface of the female hook and the top surface of the male hook, but may be installed on either of them only.

The top surface of the male hook and the bottom surface of the female hook are bonded to each other in a state of the zipper being engaged as illustrated on FIG. 5 via an easily peelable plastic layer.

Figure 8:
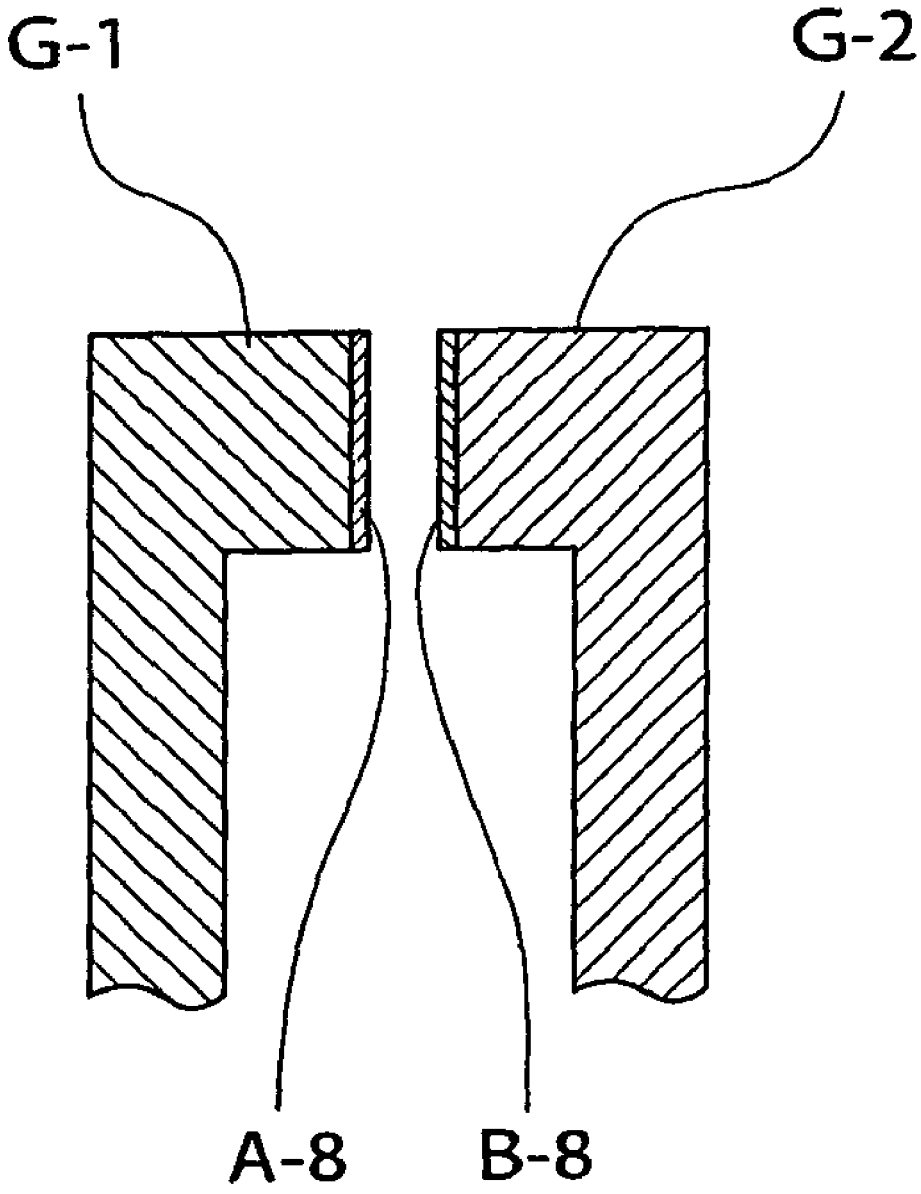
FIG. 8 is an enlarged cross sectional view showing a pair of protrusions for slider guide that are fitted on each of surfaces with an easily peelable plastic layer.
Figure 9:
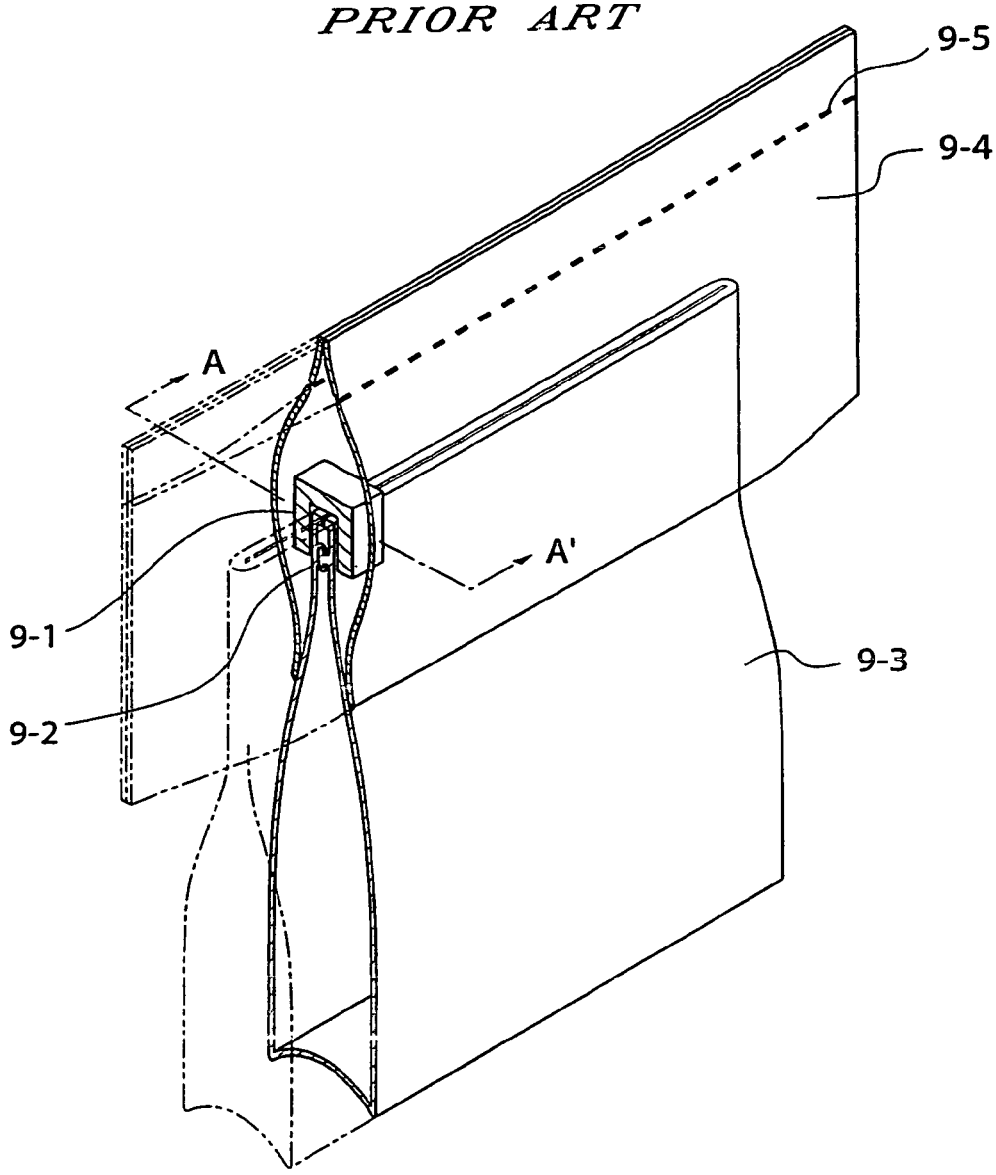
Fig9 PRIOR ART
FIG. 9 is a perspective view showing one example of well-known plastic zipper imparted with high hermetical-sealability and/or function of detecting unsealing.
Figure 10:
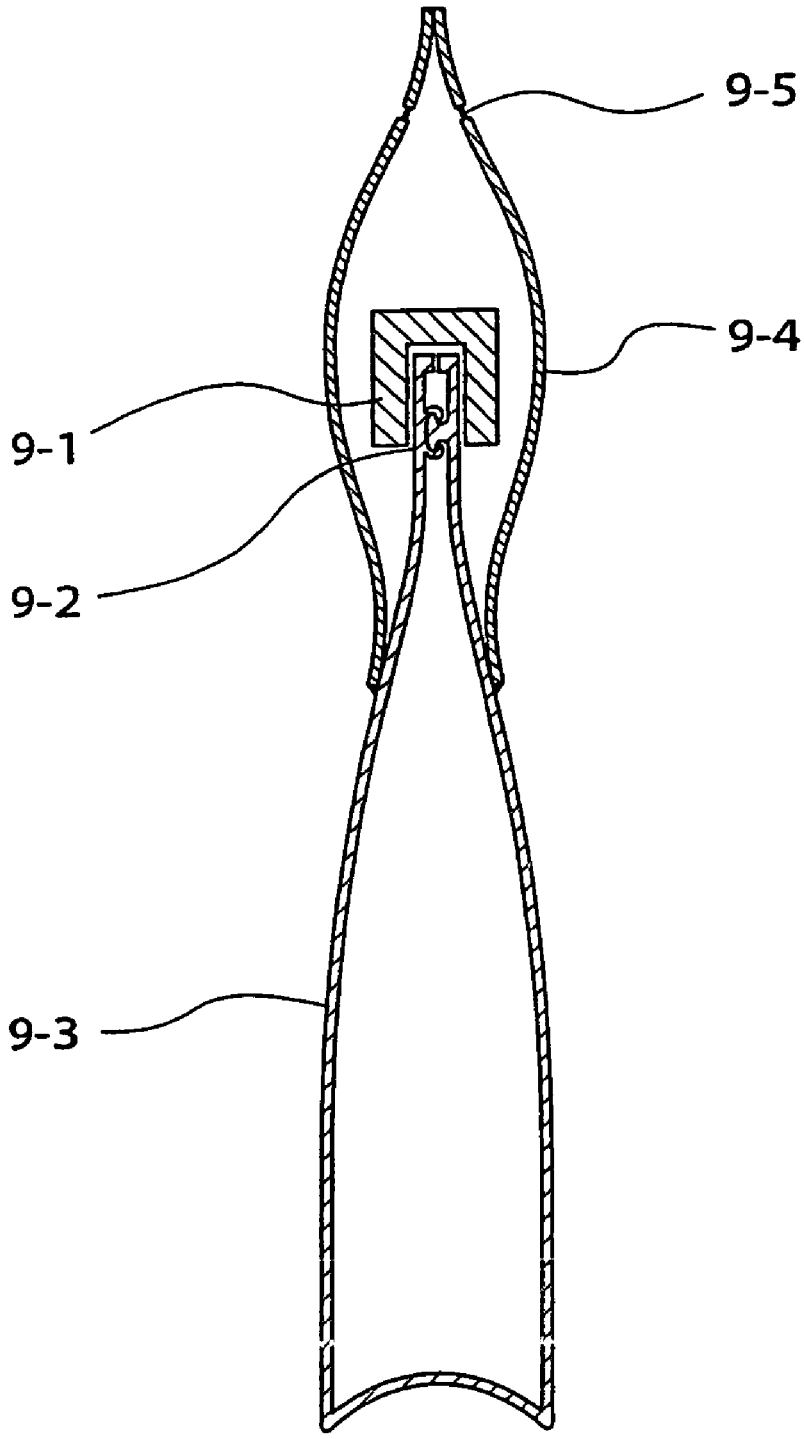
Fig10 PRIOR ART
FIG. 10 is a cross sectional view taken along line A–A' of FIG. 9.
Figure 11:
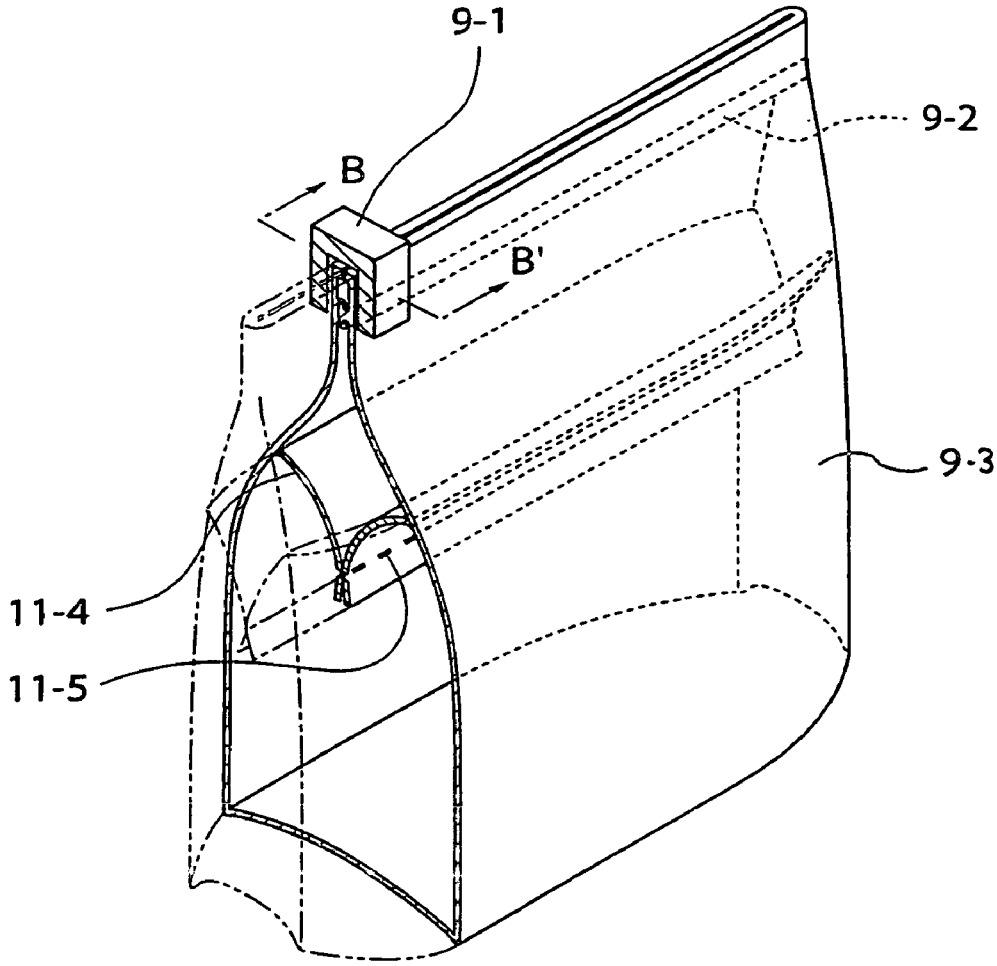
Fig11 PRIOR ART
FIG. 11 is a perspective view showing one example of well-known plastic zipper imparted with high hermetical-sealability and/or function of detecting unsealing.
Figure 12:
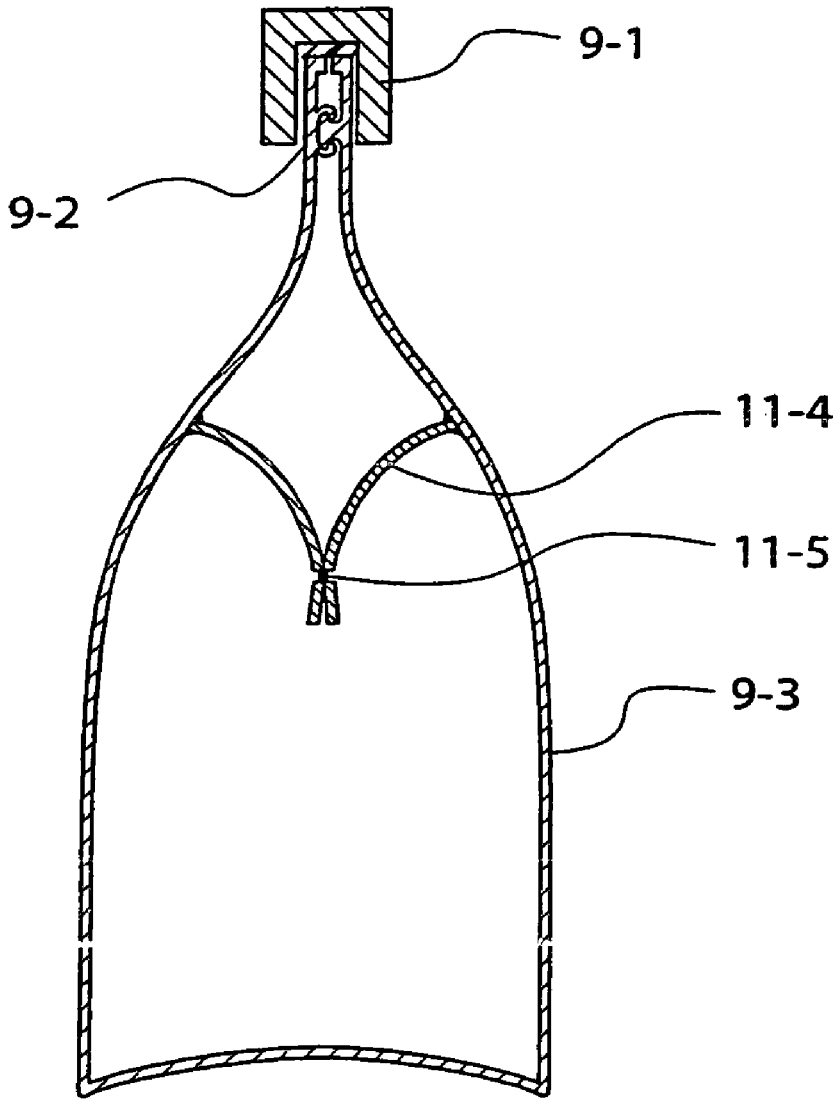
Fig12 PRIOR ART
FIG. 12 is a cross sectional view taken along line B–B' of FIG. 11.
Figure 13:
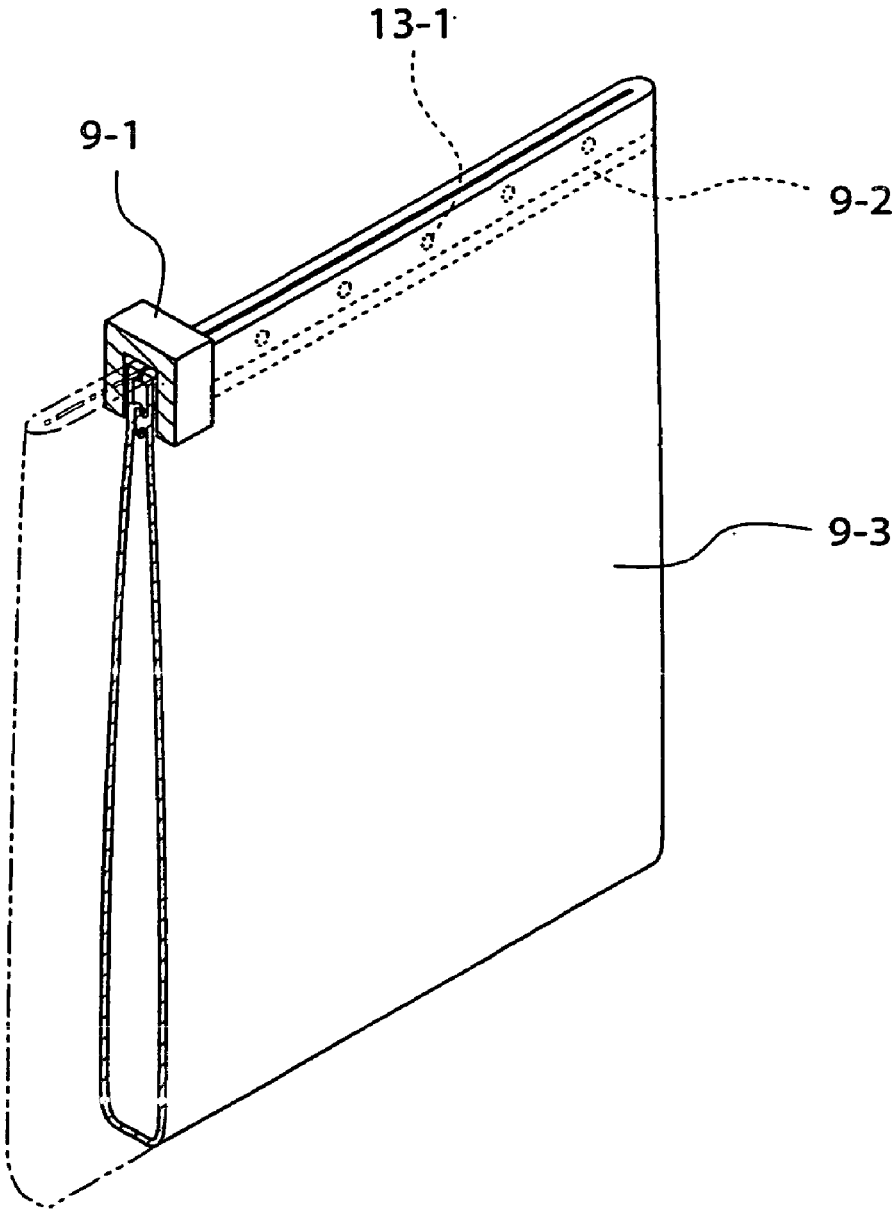
Fig13 PRIOR ART
FIG. 13 is a perspective view showing one example of well-known plastic zipper imparted with high hermetical-sealability and/or function of detecting unsealing.
Figure 14:
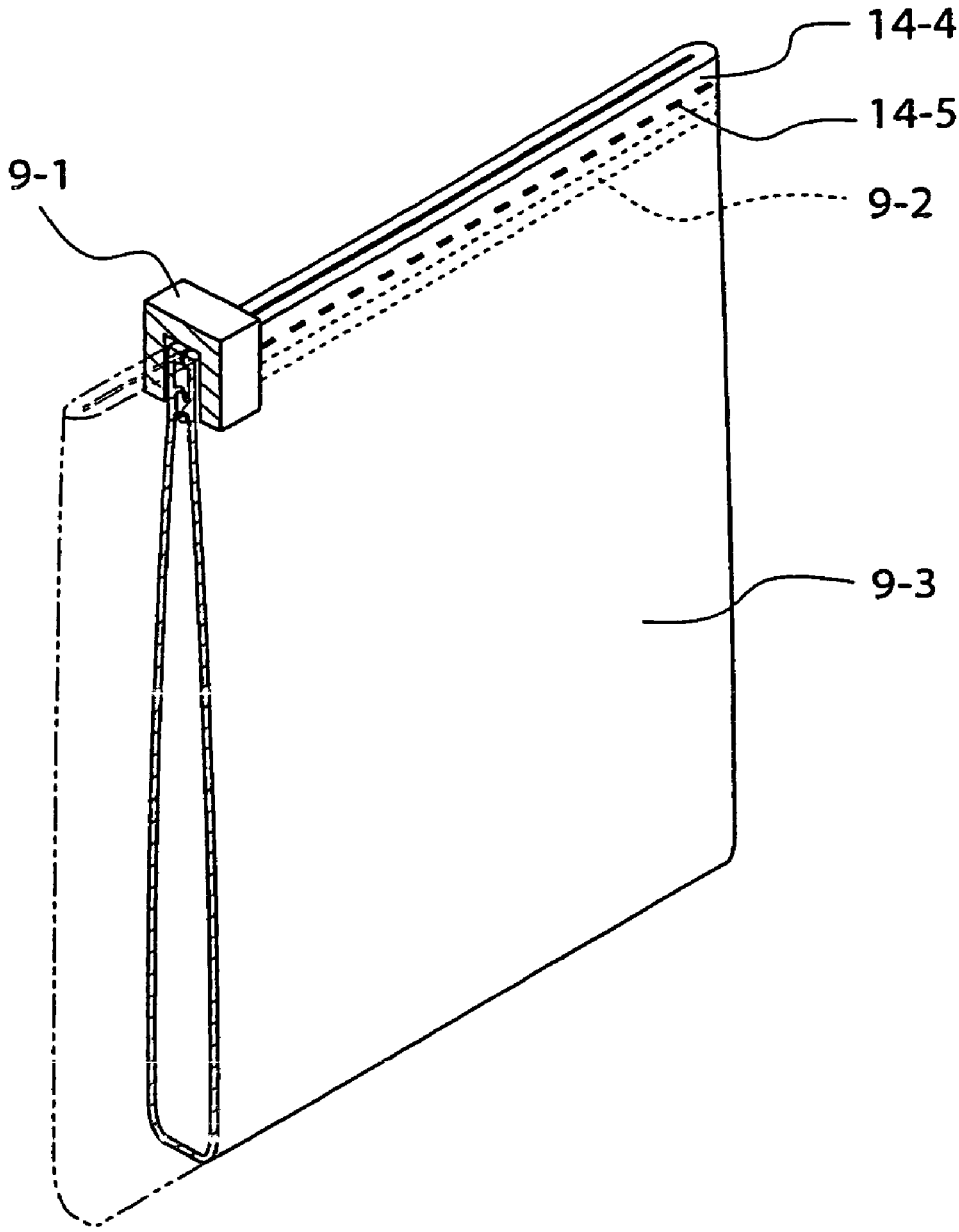
Fig14 PRIOR ART
FIG. 14 is a perspective view showing one example of well-known plastic zipper imparted with high hermetical-sealability and/or function of detecting unsealing.

In the following, some description will be given of the third aspect of the present invention with reference to FIG. 8. In the third aspect of the present invention, an easily peelable plastic layer is installed on the surface of at least one of the protrusions G-1 and G-2 for slider guide that are set up on a hermetically-sealable zipper and conventional plastic zipper as illustrated on FIG. 1 and FIG. 5. FIG. 8 is an enlarged cross sectional view showing only the protrusions for slider guide, wherein easily peelable plastic layers A-8 and B-8 are installed on the surfaces of the protrusions G-1 and G-2, respectively. However, the easily peelable plastic layer need not be installed on both the protrusions, but may be installed on either of them only. Thus both the protrusions are bonded to each other in a state of the zipper being engaged via an easily peelable plastic layer.

The fourth aspect of the present invention comprises the embodiments of both the first and third aspects of the present invention, that is, a pair of protrusions for slider guide are bonded to each other via an easily peelable plastic layer and at the same time, the continuous tightening wall and the continuous pressing rib are bonded to each other via an easily peelable plastic layer.

The fifth aspect of the present invention comprises the embodiments of both the second and third aspects of the present invention, that is, a pair of protrusions for slider guide are bonded to each other via an easily peelable plastic layer and at the same time, a top portion of the male hook and a bottom portion of the female hook are bonded to each other via an easily peelable plastic layer.

By the term "easily peelable plastic layer" as mentioned herein is generally meant a heat-sealed plastic layer having a peel strength of at most 0.6 kgf/15 mm as measured by the method described in JIS Z 0238. In the present invention, the peel strength after the adhesion between the easily peelable plastic layer to be installed in advance and a companion resin to be bonded therewith is properly at most 0.6 kgf/15 mm, preferably at most 0.3 kgf/15 mm in particular. Therein in the case where the easily peelable plastic layers are placed in advance on both sides, the companion resin is an easily peelable plastic layer, while in the case where the easily peelable plastic layer is placed in advance on either side only, the companion resin is a resin which constitutes a zipper and a protrusion for slider guide. When peel strength therein exceeds 0.6 kgf/15 mm, a big force is necessary for opening and closing operations for a zipper, thereby the protrusions for slider guide are sometimes deformed and inconvenience or trouble in opening and closing operations for a zipper are caused. Needless to say, however, a peel strength sufficient for preventing easy peeling is necessary in the case where a zipper is placed in an ordinary state without receiving a force in particular.

The materials which constitute the above-described easily peelable plastic layers are not specifically limited, but exemplified by resin compositions that are usually employed as easily peelable plastics such as polybutene, ethylene/vinyl acetate copolymer, polyethylene/polypropylene mixture and resin mixtures containing these resins. With regard to the mechanism of easy peelability, interfacial peeling is excellent as compared with cohesive peeling in terms of preservation of hermetical sealability at the time of opening/closing a zipper after unsealing.

The heat seal temperature of the easily peelable plastics is preferably lower than the melting point of the resin constituting the zipper.

In the case of heat sealing a bag body fitted with a zipper in which part thereof is bonded in a state of the zipper being engaged via an easily peelable plastic layer, there is usually adopted without specific limitation, a method in which a prospective content is filled in the bag body through the bottom thereof in a state of the zipper being engaged and thereafter, the filling port is heat sealed (hereinafter the bag is referred to as "bottom opened bag").

A method for bonding part of a zipper by means of an easily peelable plastic layer may be properly optionally selected in accordance with the physical properties of the layer to be used from among a heat sealing method using a hot air nozzle, a method using a heat sealing hot plate, a method using a ultrasonic heat sealing machine, a method using a high-frequency heat sealing machine and the like.

In regard to the timing of adhesion with the easily peelable plastic, it is preferably put into practice at the time of producing a bag body fitted with a zipper by the use of a bag making machine in the case of a bottom opened flat bag or the like, while in the case of a gusset bag or the like, it follows that adhesion is conducted after the prospective content is filled in the bag by using a heat sealing machine attached to a filling machine.

On the portion to be bonded using the easily peelable plastic layer, by taking a bicolor system, that is, making the color of the easily peelable plastic layer to be installed in advance different from the color of a companion resin to be bonded therewith, it is enabled to impart the function capable of detection of having been unsealed after sealing packaging. Therein in the case where the easily peelable plastic layers are placed in advance on both sides, the companion resin is an easily peelable plastic layer, while in the case where the easily peelable plastic layer is placed in advance on either side only, the companion resin is a resin which constitutes a zipper and a protrusion for slider guide. In the case of selecting yellow and blue as bicolor, the adhesion portion in a state of bonded (heat sealed) assumes green, but turns yellow and blue after peeling, and never returns to green unless adhesion (heat sealing) procedure is carried out again, thereby clarifying the fact of having been unsealed.

In the case of the first and second aspects of the present invention where adhesion of the zipper is made via the easily peelable plastic layer, the color change is somewhat difficult to observe in a state of the zipper being closed. However in the case of the third to fifth aspects thereof where adhesion of the protrusions is made via the easily peelable plastic layer, the color change is remarkably observed.

In the case where the easily peelable plastic layer is placed in advance on either side only, it is preferable that the companion resin for adhesion which constitutes the zipper and/or protrusions for slider guide be colored on the surface portion thereof alone, since change in color tone due to peeling becomes easier to observe.

Implementation methods for opening the bag body fitted with the zipper bonded via the easily peelable plastic layer by the use of the slider include a method wherein the zipper is completely opened, including the adhesion portion via the easily peelable plastic layer and a method comprising regulating the size of the inside guide of slider 15-1 as illustrated on FIG. 15, so that even when the slider is brought to the fully open position, the zipper is partially opened, whereas the adhesion portion via the easily peelable plastic layer remains unopened; opening the adhesion portion for the first time by opening part of the zipper with fingertip so as to enable free opening and closing with the slider after the zipper is once opened. Of these, the latter method can exhibit the effect on detecting unsealing as well.

In the following, the present invention will be described in more detail with reference to comparative example and working examples, which however shall never limit the present invention thereto.

EXAMPLE 1

There was prepared a hermetically-sealable zipper as illustrated on FIG. 1 and FIG. 2 the material of which was LLDPE (linear low density polyethylene resin), which measured 3.9 mm in width and 2.6 mm in thickness in engaged state, and was in the form of tape (hereinafter referred to as "sealed zipper-1"), by providing a female zipper (the portion comprising female hooks, a flange and a protrusion for slider guide each on the side having female hooks) which was colored transparent-yellow; a male zipper (the portion comprising male hooks, a flange and a protrusion for slider guide each on the side having male hooks) which was colorless transparent; a transparent-blue easily peelable plastic layer the material of which was a mixture of LLDPE, ethylene/vinyl acetate copolymer and polybutene, which measured 10 μm in thickness, and which had a peel strength regulated to 0.31 kgf/15 mm, and which was placed on the surface of a continuous tightening wall as illustrated on FIG. 4; content side flange portions measuring 300 μm in thickness and 10 mm in width; opening side flange portions measuring 300 μm in thickness; protrusions which measured 1.5 mm in length and 0.8 mm in height, and which was positioned at 1.9 mm from the female hooks on both the male and female flanges; and further a transparent-blue easily peelable plastic layer the material of which was a mixture of LLDPE, ethylene/vinyl acetate copolymer and polybutene, which measured 10 μm in thickness, and which had a peel strength regulated to 0.31 kgf/15 mm, and which was placed as illustrated on FIG. 8 but only on the inside surface of the protrusions on the male hook side so that the continuous tightening wall and continuous pressing rib were bonded to each other via the easily peelable plastic layer in a state of the zipper being engaged.

Subsequently, there were prepared bottom opened flat bags which measured 140 mm in width and 200 mm in height by dry laminating a LLDPE film, an aluminum foil and a polyamide resin film having a thickness of 60 μm, 12 μm and 15 μm, respectively, from the inside towards outside of a prospective bag so as to form a laminate film, bonding through heat sealing, the flange portions of the sealed zipper-1 in a width of 4 mm to the inside of the resultant laminate film and thereafter heat sealing both the ends through heat sealing in a width of 4 mm. Then a slider was attached to the top of the bag thus prepared and thereafter the inside portion of the protrusions out of contact with the slider on the top end of the sealed zipper was heat-sealed. As a result, the heat-sealed portion turned green.

Subsequently, the sealed zipper was opened by operating the slider, whereupon the green color disappeared on the protrusions (and the joint of the continuous tightening wall and continuous pressing rib), whereby separation into blue and yellow was visualized. Thereafter, the sealed zipper was closed by operating the slider, whereupon green color linearly remained in part, but never returned to the original green color of the time of the adhesion. Thereby it was made possible to confirm the function of detecting unjust unsealing.

The above-mentioned bottom opened flat bags which each measured 140 mm in width and 200 mm in height and which were each fitted with the sealed zipper with a slider attached were prepared in 20 numbers.

Comparative Example 1

Two sheets of tapes the material of which was LLDPE and which measured 300 μm in thickness in and 15 mm in width were interposed, one end of the tapes was heat sealed each other in a width of 4 mm, and the other end thereof was heat sealed in a width of 4 mm onto the inside of the a laminate film whose material and size were the same as those of the film which had been used for the preparation of the above-mentioned bottom opened flat bags each fitted with the sealed zipper with a slider attached. Thereafter both the ends were heat sealed in a width of 4 mm.

As a result, the bottom opened flat bags which each measured 140 mm in width and 200 mm in height and which were each sealed at the three sides including the top portion and both the sides were prepared in 20 numbers.

Nitrogen gas at a relative humidity of 50% in a volume of 700 milliliter (ml) was filled in each of the bags which had been prepared in Example 1 and Comparative Example 1, respectively so that the nitrogen gas was enclosed inside the bags by heat sealing the bottom portion in a width of 4 mm. Then, 10 bags×2 types of nitrogen-filled bags out of these 20 bags×2 types thereof were each used to measure the initial concentration, and the remaining bags were allowed to stand in a steel box which was filled inside with oxygen gas at ordinary temperature, atmospheric pressure and a relative humidity of 50% for 100 hours and thereafter, were subjected to the measurement of oxygen concentration of the nitrogen gas inside the bags. The results are given in Tables 1, where no significant difference was recognized in oxygen permeation amount between the bags of Example 1 and Comparative Example 1, whereby it was confirmed that the sealed zipper of Example 1 had hermetical sealability comparable to that of the heat seal of Comparative Example 1.

In addition, it was confirmed that after once opened, the sealed zipper exhibited the functions of a hermetically-sealable zipper for general purpose.

EXAMPLE 2

There was prepared a colorless transparent hermetically-sealable zipper as illustrated on FIG. 1 and FIG. 2 the material of which was LLDPE (linear low density polyethylene resin), which measured 3.9 mm in width and 2.6 mm in thickness, and was in the form of tape (hereinafter referred to as "sealed zipper-2"), by providing content side flange portions measuring 300 μm in thickness and 10 mm in width; opening side flange portions measuring 300 μm in thickness; protrusions which measured 1.5 mm in length and 0.8 mm in height, and which was positioned at 1.9 mm from the female hooks on both the male and female flanges; easily peelable plastic layers as illustrated on FIG. 3 and FIG. 4 on the surfaces of both a continuous pressing rib and a continuous tightening wall and further; easily peelable plastic layers as illustrated on FIG. 8 on the inside surfaces of both the protrusions, each of which layers measured 10 μm in thickness, was made of a mixture of LLDPE, ethylene/vinyl acetate copolymer and polybutene, and had a peel strength regulated to 0.25 kgf/15 mm, wherein either the continuous pressing rib side or the continuous tightening wall side and either of both the protrusions insides were colored transparent-yellow, and the others were colored transparent-blue, and by bonding the continuous tightening wall and continuous pressing rib to each other via the easily peelable plastic layer in a state of the zipper being engaged, so that the color of the adhesion portion turned green.

Subsequently, there were prepared bottom opened flat bags which measured 140 mm in width and 200 mm in height in the same manner as in Example 1, and by the use of the sealed zipper-2 thus prepared, a slider was attached to the top of the bag thus prepared and thereafter the inside portion of the protrusions out of contact with the slider on the top end of the sealed zipper was heat sealed. As a result, the heat-sealed portion turned green.

Subsequently, the sealed zipper was opened by operating the slider, whereupon the green color disappeared on the protrusions, whereby separation into blue and yellow was visualized. Thereafter, even when the sealed zipper was closed by operating the slider, the color never returned to the original green color of the time of the adhesion. Thereby it was made possible to confirm the function of detecting unjust unsealing. Moreover, by opening the sealed zipper the green color on the joint of the continuous tightening wall and continuous pressing rib disappeared, whereby separation into blue and yellow was visualized.

The above-mentioned bottom opened flat bags which measured 140 mm in width and 200 mm in height and which was fitted with the sealed zipper with a slider attached were prepared in 20 numbers. Subsequently, oxygen permeation amount was measured in the same manner as in Example 1. The results are given in Table 1, thus enabling to confirm that the sealed zipper of Example 2 had hermetical sealability comparable to that of the heat seal of Comparative Example 1.

TABLE 1

| | | Example 1 | | Comp. Example 1 | | Example 2 | |
|---|---|---|---|---|---|---|---|
| | | Average value | Standard Deviation | Average value | Standard deviation | Average value | Standard deviation |
| Number of samples | | 10 | 10 | 10 | 10 | 10 | 10 |
| Oxygen conc (%) | initial | 0.036 | 0.006 | 0.036 | 0.005 | 0.036 | 0.005 |
| | after 100 Hr | 0.789 | 0.113 | 0.731 | 0.121 | 0.764 | 0.108 |

Remarks
Comp.: Comparative,
conc.: concentration

INDUSTRIAL APPLICABILITY

According to the present invention, it is made possible to provide a bag body fitted with a zipper with a slider attached which bag body is capable of assuring high hermetical-sealability enabling long-term preservation of contents therein, is easy to open, and is imparted with a function of revealing unjust unsealing as well, since a pair of male and female hooks and/or protrusions for slider guide are bonded via easily peelable plastic layers.

The invention claimed is:

1. A highly hermetically-sealable plastic zipper equipped with a slider, comprising a pair of male hook and female hook formed on surfaces of plastic films, a pair of protrusions for slider guide which are installed parallel to each of the male hook and female hook on the side of the opening portion, a continuous tightening wall which is parallel to the male hook and placed inside the male hook and a continuous pressing rib which is parallel to the female hook and placed inside the female hook, wherein the pair of protrusions for slider guide are bonded to each other in a state of the zipper being engaged via an easily peelable plastic layer which is installed in advance on the inside surface of at least one of the protrusions and at the same time, the continuous tightening wall and the continuous pressing rib are bonded to each other in a state of the zipper being engaged via an easily peelable plastic layer which is installed in advance on the surface of at least one of the continuous tightening wall and the continuous pressing rib.

2. The highly hermetically-sealable plastic zipper equipped with a slider as set forth in claim 1, wherein the color of the surfaces of the portions that are bonded to each other comprises two different colors.

3. The highly hermetically-sealable plastic zipper equipped with a slider as set forth in claim 1, wherein the easily peelable plastic layer at the portion bonded via an easily peelable plastic layer which is installed in advance has a peel strength of at most 0.3 kgf/15 mm.

4. A bag body fitted with a plastic zipper with a slider attached as set forth in claim 1.

* * * * *